US009403044B2

(12) United States Patent
Pirone

(10) Patent No.: US 9,403,044 B2
(45) Date of Patent: Aug. 2, 2016

(54) OUTERWEAR SYSTEM INCORPORATING A BASE GARMENT WITH ATTACHABLE OUTER SKINS, SUCH AS FOR PROVIDING TERRAIN DICTATED CAMOUFLAGE

(71) Applicant: Paul Pirone, Clarkston, MI (US)

(72) Inventor: Paul Pirone, Clarkston, MI (US)

( * ) Notice: Subject to any disclaimer, the term of this patent is extended or adjusted under 35 U.S.C. 154(b) by 299 days.

(21) Appl. No.: 14/190,283

(22) Filed: Feb. 26, 2014

(65) Prior Publication Data

US 2014/0237711 A1 Aug. 28, 2014

Related U.S. Application Data

(60) Provisional application No. 61/769,634, filed on Feb. 26, 2013.

(51) Int. Cl.
*A41D 27/08* (2006.01)
*A62B 17/00* (2006.01)
*F41H 3/02* (2006.01)

(52) U.S. Cl.
CPC ..... *A62B 17/00* (2013.01); *A41D 27/08* (2013.01); *F41H 3/02* (2013.01); *A41D 2600/108* (2013.01); *Y10S 2/90* (2013.01)

(58) Field of Classification Search
CPC ..... A62B 17/00; A42B 1/004; F41H 1/02; F41H 3/02; A41D 15/002; A41D 27/08; A41D 2600/108; Y10S 2/90
USPC ..... 2/458, 244, 227, 94, 101
See application file for complete search history.

(56) References Cited

U.S. PATENT DOCUMENTS 646,356 A * 3/1900 Champlain, Jr. ..... A41D 1/04 2/115
1,139,642 A * 5/1915 Cox ..... A41D 29/00 2/1
1,731,137 A * 10/1929 Jones ..... A41D 1/22 2/48
1,854,476 A * 4/1932 Mason ..... A41D 3/08 2/85
2,073,231 A * 3/1937 Siegel ..... A41D 3/02 2/97
2,527,258 A * 10/1950 Kahn ..... A41D 3/00 2/115
2,647,261 A * 8/1953 Rassner ..... A41D 1/04 2/115
2,685,690 A * 8/1954 Chrisman ..... G09F 21/02 2/1
2,711,539 A * 6/1955 Loscher ..... A41D 15/005 2/93
3,582,993 A * 6/1971 Keller ..... A41D 1/22 2/74

(Continued)

*Primary Examiner* — Alissa L Hoey
(74) *Attorney, Agent, or Firm* — Dinsmore & Shohl LLP; Douglas J. McEvoy

(57) ABSTRACT

A system for providing any plurality of exchangeable (typically thin-walled and lightweight) outer skins in combination with a wearable base garment, the base garment selected from as at least one of a one-piece suit, pants or a jacket and exhibiting a plurality of fasteners. A first selected outer skin is configured for positioning in overlaying fashion relative to any of the pants or jacket of the base garment. The outer skin exhibits a further plurality of fasteners which inter-engage with the first plurality of fasteners. The first skin exhibits a first decorative pattern and, upon being detached from the base garment, can be substituted by a second identically constructed skin exhibiting a second decorative pattern.

7 Claims, 16 Drawing Sheets

(56) References Cited

U.S. PATENT DOCUMENTS 3,661,689 A 5/1972 Spanier
4,103,361 A * 8/1978 Carmen ..... A41D 27/04 2/97
4,215,435 A * 8/1980 Miele ..... A41D 15/002 2/227
4,517,230 A * 5/1985 Crawford ..... F41H 3/00 2/900
4,715,068 A * 12/1987 Jacobson ..... A41D 27/04 2/272
4,768,233 A * 9/1988 Grilliot ..... A62B 17/003 2/81
4,792,471 A * 12/1988 Lee ..... F41H 3/00 2/900
4,860,387 A * 8/1989 Williams ..... A41D 27/08 2/244
4,865,900 A * 9/1989 Shannon ..... F41H 3/00 2/900
4,868,019 A * 9/1989 Knickerbocker ..... F41H 3/00 156/61
4,959,876 A * 10/1990 Kalaam ..... A62B 17/003 2/81
5,029,344 A * 7/1991 Shannon ..... A41D 15/005 2/115
5,038,410 A * 8/1991 Grilliot ..... A62B 17/003 2/272
5,054,125 A * 10/1991 Snedeker ..... A62B 17/003 2/272
5,054,127 A * 10/1991 Zevchak ..... A41D 27/20 2/227
5,086,516 A * 2/1992 Baxter ..... A41D 1/02 2/102
5,088,116 A * 2/1992 Gould ..... A41D 3/06 2/115
5,136,726 A * 8/1992 Kellin ..... A41D 27/08 2/115
5,159,718 A * 11/1992 Moyer ..... A41D 13/01 2/102
5,168,580 A * 12/1992 Foo ..... A41D 15/00 2/115
5,203,033 A * 4/1993 Sheppard, Sr. ..... A41D 13/00 2/244
5,228,140 A * 7/1993 Baustin ..... A41D 1/00 2/247
D338,772 S * 8/1993 Sauls ..... D2/742
5,274,848 A * 1/1994 Shamblin ..... A41D 13/00 2/69
5,281,460 A * 1/1994 Cox ..... F41H 3/02 2/69
5,308,671 A * 5/1994 Wells ..... A41B 11/001 2/245
5,347,659 A * 9/1994 Tibljas ..... A41D 13/00 2/1
5,416,928 A * 5/1995 Koenig ..... A41D 27/08 2/105
D363,594 S * 10/1995 Nethken, Jr. ..... D2/851
5,465,425 A * 11/1995 Crispin ..... A41D 13/0012 2/102
5,640,715 A * 6/1997 Adams ..... A41B 13/10 2/105
5,742,939 A * 4/1998 Williams ..... A41D 1/00 2/456
5,794,267 A * 8/1998 Wallace ..... A41D 27/08 2/115
5,800,900 A * 9/1998 Mitchell ..... A41D 27/08 2/244
5,813,051 A * 9/1998 Counter ..... G09F 21/02 2/102
5,884,332 A * 3/1999 Snedeker ..... A62B 17/003 2/227
5,894,600 A * 4/1999 Chenefront ..... A41D 15/00 2/105
5,958,526 A * 9/1999 Spickelmire ..... F41H 3/00 2/244
6,041,436 A 3/2000 Keen
6,047,404 A * 4/2000 Blanks ..... A41D 15/00 2/108
6,060,142 A * 5/2000 Rossini ..... F41H 3/00 2/1
6,060,412 A 5/2000 Ishida
6,061,828 A * 5/2000 Josephs ..... A41D 29/00 2/69
6,182,291 B1 * 2/2001 Garvey ..... A41D 13/0012 2/102
6,345,393 B1 * 2/2002 Bayer ..... A41D 3/02 2/94
6,408,438 B1 * 6/2002 Mc Kee ..... A41D 15/002 2/244
6,477,710 B1 * 11/2002 Ojoyeyi ..... A41D 13/1236 2/114
6,481,017 B2 * 11/2002 Mullis ..... A41D 13/01 2/16
6,499,141 B1 12/2002 Egnew
6,523,180 B1 * 2/2003 Christopher ..... A01K 15/02 119/714
6,599,649 B2 7/2003 Martin
6,656,013 B1 * 12/2003 Wang ..... A41F 15/002 2/244
6,848,118 B2 * 2/2005 Barnes ..... A41D 3/005 2/108
6,851,126 B1 2/2005 Humphreys
6,910,223 B2 6/2005 Egnew
6,991,690 B2 1/2006 Strength et al.
7,003,805 B1 * 2/2006 Woodfork, Jr. ..... A41D 3/04 2/85
7,065,793 B1 * 6/2006 Wooten ..... A41D 13/00 2/69
7,201,629 B2 * 4/2007 Lambru ..... A41C 3/06 2/310
7,251,840 B2 * 8/2007 Bayer ..... A41D 3/00 2/227
7,426,755 B2 * 9/2008 Grilliot ..... A62B 17/003 2/81
7,441,281 B2 * 10/2008 Salem ..... A41D 1/04 2/115
7,987,522 B2 8/2011 Morgan et al.
8,032,951 B1 * 10/2011 Nestberg ..... A41D 13/0012 2/247
8,042,196 B1 10/2011 Kirby
8,312,564 B2 * 11/2012 Beshlian ..... A41D 13/1209 2/46
8,425,072 B2 * 4/2013 Hurwitz ..... A41D 27/08 362/103
8,453,267 B1 * 6/2013 Stanley ..... A41D 27/08 2/227
9,204,676 B2 * 12/2015 Gbadamosi ..... A41D 27/201
2002/0116748 A1 * 8/2002 Lipsett ..... A41D 1/06 2/227
2003/0188469 A1 * 10/2003 Torres ..... G09F 15/0006 40/586
2003/0221244 A1 * 12/2003 Liddell ..... A41D 27/08 2/244
2004/0154076 A1 * 8/2004 Yoo ..... A41D 27/04 2/247
2004/0221358 A1 * 11/2004 Briscoe ..... A41D 11/00 2/69
2005/0044610 A1 * 3/2005 Grimes ..... A41D 27/08 2/244
2005/0060784 A1 * 3/2005 Emeth ..... A41D 27/08 2/93
2005/0198724 A1 * 9/2005 Steitle ..... A41D 27/08 2/244
2006/0143779 A1 * 7/2006 Lee ..... A41D 13/0015 2/115
2006/0162040 A1 * 7/2006 Lee ..... A41D 1/14 2/71
2006/0174391 A1 8/2006 Shannon
2007/0094763 A1 * 5/2007 Silver ..... A41D 13/00 2/69
2007/0118957 A1 * 5/2007 Steitle ..... A41D 1/06 2/69
2007/0214547 A1 * 9/2007 Mullen ..... A41D 1/06 2/227

(56) References Cited

U.S. PATENT DOCUMENTS

2008/0092265 A1* 4/2008 Gage ..... A41D 27/10 2/69
2010/0064407 A1* 3/2010 Beshlian ..... A41D 13/1209 2/48
2010/0107310 A1* 5/2010 Taylor ..... A41F 9/002 2/301
2010/0192276 A1* 8/2010 Anderson ..... A41D 1/04 2/115
2010/0199399 A1* 8/2010 Garza ..... A41D 15/002 2/24
2010/0199404 A1* 8/2010 Garza ..... A41D 3/02 2/84
2010/0257658 A1* 10/2010 Schwietz-Flauto .... A41D 27/08 2/207
2010/0269239 A1* 10/2010 Kulp ..... A41D 27/08 2/69
2010/0277944 A1* 11/2010 Hurwitz ..... A41D 27/08 362/570
2010/0277945 A1* 11/2010 Hurwitz ..... A01K 13/003 362/570
2010/0293700 A1* 11/2010 Gillespie ..... A41D 15/002 2/244
2011/0072551 A1 3/2011 Roberts
2012/0017353 A1 1/2012 Morgan et al.
2012/0137399 A1* 6/2012 Forte ..... A47G 1/0616 2/69
2012/0204309 A1* 8/2012 Sullivan ..... A41D 13/01 2/69
2012/0204313 A1* 8/2012 Evans ..... A41F 5/00 2/70
2012/0211156 A1 8/2012 Harvey et al.
2012/0213963 A1 8/2012 Lee
2012/0304361 A1* 12/2012 Jeffords ..... A41D 1/06 2/227
2013/0205468 A1* 8/2013 Ceo ..... A41D 13/0002 2/94
2013/0318689 A1* 12/2013 Williams ..... A41D 27/10 2/269
2016/0015101 A1* 1/2016 Stefanovic ..... A41D 27/08 2/244

* cited by examiner

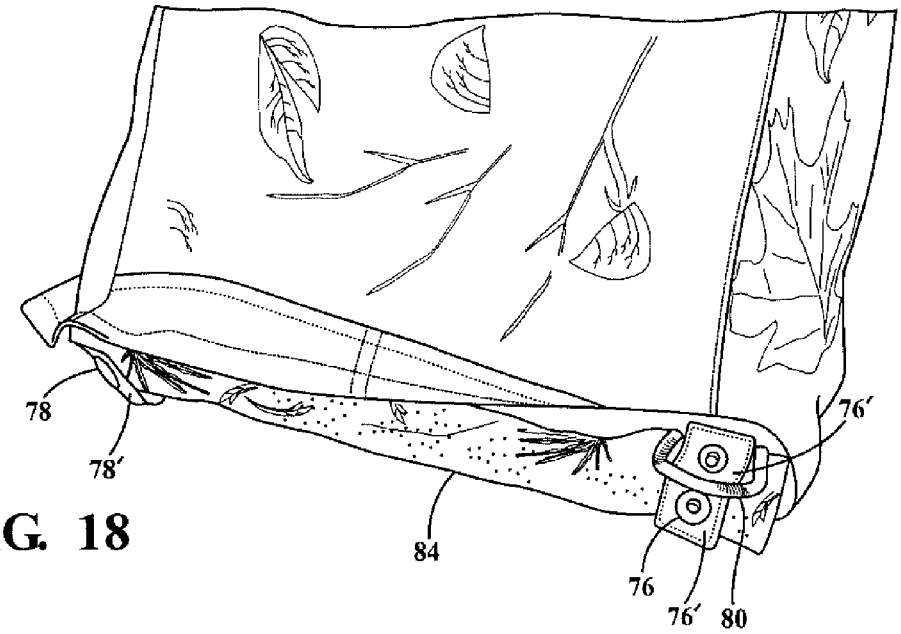
FIG. 18
FIG. 19
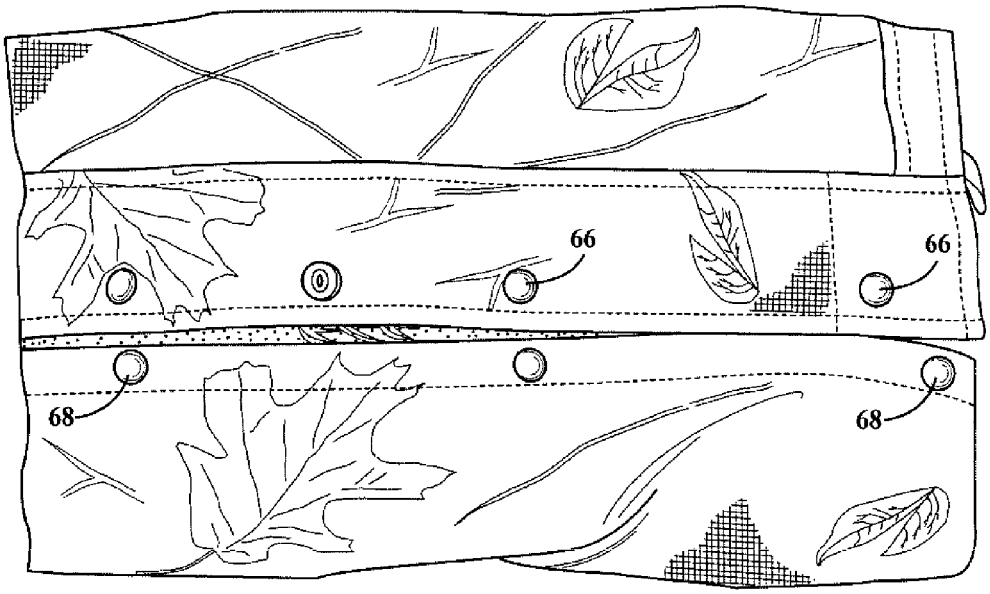

OUTERWEAR SYSTEM INCORPORATING A BASE GARMENT WITH ATTACHABLE OUTER SKINS, SUCH AS FOR PROVIDING TERRAIN DICTATED CAMOUFLAGE

CROSS-REFERENCE TO RELATED APPLICATIONS

This Application claims the benefit of U.S. Provisional Application 61/769,634 filed on Feb. 26, 2013, the contents of which is incorporated herein by reference in its entirety.

FIELD OF THE INVENTION

The present invention relates generally to a camouflage style outerwear system for providing a base wearable component with multiple interchangeable outer skins. More specifically, the invention discloses such a system providing any plurality of outer interchangeable skins, each exhibiting a different pattern or style corresponding to a desired outdoor environment, and which are individually attached or removed from the base garment (one piece jump suit or separate pants/bibs or top) by the use of any of zippers, snaps, magnetic attachable portions, buttons or hook & loop (Velcro®) style fasteners. Access slots or linings can be configured at overlapping attachment locations established between the base (underbody) suit and each outer skin to facilitate inter-engagement of the skin to the underbody. As will be further described, the system can encompass any hunting or military related applications in which it is desired to exhibit a maximum number of different camouflage patterns with a minimum of outerwear gear, as well as any other non-related recreational pursuits such as paintball or snowboarding, where there is an advantage in the ability to provide fast changing outer skins. Finally, the skins can integrate any number of integrated components, such as without limitation including ballistic resistant (Kevlar®) panels, accessory support portions, and hydration (fluid reservoir) packs. Other features of the skins can include infrared (IR) or thermal insulating properties, additional variants further contemplating more one skin being applied in successive layered fashion depending upon the operational environment.

BACKGROUND OF THE INVENTION

The prior art is well documented with examples of outerwear, such as a one piece suit or individual bib and jacket, and which are worn by individuals engaged in a variety of pursuits, including such as military applications, hunting and the like. Given the differences in terrain associated with varying geography, a given camouflage design coating the exterior of the outwear suit may not be equally optimal or even suitable for all such geographies. Accordingly, the user is often faced with the unenviable requirement of having to purchase any number of outerwear suits, each exhibiting a different exterior camouflage pattern or design and corresponding to a selected locale.

Also noted in the prior art are a pair of related references disclosing systems and methods for providing modular camouflage (referring to Morgan US 2012/0017353 and U.S. Pat. No. 7,987,522) and which include a retaining mechanism and at least two coupling mechanisms for attaching the device to the clothing or directly to the wearer, the user immobilizing the camouflage material by inserting it between the retaining mechanism and the apparel or person.

Additional references are directed to Ghillie suit related disclosures (generally defined as a base net or mesh fabric with sufficiently large openings for permitting attachment of leaf-like elements). Reference in particular is made to each of Humphrey's, U.S. Pat. No. 6,851,126 and Rossini, U.S. Pat. No. 6,060,142. Other references depicting attachable panels or apparel items include each of Shannon, US 2006/0174391 and Spanier, U.S. Pat. No. 3,661,689.

SUMMARY OF THE INVENTION

The present invention discloses a camouflage outerwear system which includes a base suit (either one piece or with separate top and bibs), along with a plurality of outer interchangeable skins, each exhibiting a different pattern or style corresponding to a desired outdoor environment. The skins are individually attached or removed from the base suit by the use of any of zippers, snaps or buttons.

Depending upon the fasteners used, access slots or linings can be configured into the design to facilitate inter-engagement of the skins to the underbody. The camouflage outerwear system depicted is understood to not be limiting strictly to hunting or military related applications in which it is desired to exhibit a maximum number of different camouflage patterns with a minimum of outerwear gear, but can also include other non-related recreational pursuits such as paintball or snowboarding, where there is an advantage in the ability to provide fast changing outer skins.

In one non-limiting application a system for providing any plurality of exchangeable (typically thin-walled and lightweight) outer skins in combination with a wearable base garment includes the base garment being selected from as at least one of pants or a jacket and exhibiting a first plurality of fasteners. A first selected outer skin is configured for positioning in overlaying fashion relative to at least one of the pants and jacket of the base garment, the outer skin garment exhibiting a second plurality of fasteners which inter-engage with the first plurality of fasteners.

The first outer skin exhibits a first decorative pattern and, upon being detached from the base garment, can be substituted by a second identically constructed outer skin exhibiting a second decorative pattern. Additional features include first and second pluralities of inter-engaging fasteners incorporating any one or more of zippers, snaps and hook & loop fasteners. The outer skins, as previously described, can each exhibit a different camouflage decorative pattern and the base garment can further include either of a one piece suit or separately attachable bibs and top.

Finally, the skins can integrate any number of integrated components, such as without limitation including ballistic resistant (Kevlar®) panels, accessory support portions, and hydration packs. Other features of the skins can include infrared (IR) or thermal insulating properties, additional variants further contemplating more one skin being applied in successive layered fashion depending upon the operational environment.

BRIEF DESCRIPTION OF THE DRAWINGS

Reference will now be made to the attached drawings, when read in combination with the following detailed description, wherein like reference numerals refer to like parts throughout the several views, and in which:

FIG. 18 is a semi-engaged position of the outer skin at leg cuff showing the loop and snap attachment scheme; to FIG. 19 is an illustration of the outer skin fully engaged to the boot welt area and leg cuff;

FIG. 21A is an illustration of a further variant of attachable skin, such as which my integrate a combination of ballistic impact resistant panels along with sewn in or otherwise integrated hydration packs and the like;

DETAILED DESCRIPTION OF THE PREFERRED EMBODIMENTS

As previously described, the present invention relates generally to a camouflage style outerwear system for providing a base wearable component, along with multiple interchangeable outer skins or like components. As will be described in further detail throughout an explanation of the succeeding preferred embodiments, a plurality of outer interchangeable skins are provided in combination with the wearable base component, such as a one piece suit or a combination bibs and top.

Each of the outer skins can exhibit a different pattern or style corresponding to a desired outdoor environment and which is further understood to not be limiting to different camouflage style patterns to the various illustrations are directed and which are individually attached or removed from the base suit by the use of any of zippers, snaps, magnetic attracting portions, buttons or hook and loop fasteners which are arranged as first and second opposing pluralities between the exterior surfaces and ends of the under/base component and the opposing inner surfaces and ends of the exteriorly attachable skins.

As will also be disclosed, access slots or linings can be configured at overlapping attachment locations established between the base (underbody) suit and each outer skin to facilitate inter-engagement of the skin to the underbody and for quickly attaching or detaching/substituting a given skin (such as depicting a first camouflage pattern) with a second skin depicting an alternate pattern. The desire to substitute the exterior decorative appearance of the wearable system which can be accounted for by a change in any of geography or season (e.g. summer to winter) and in which a suitable alternate exterior covering is desired without the wearer having to undertake the major expense of purchasing another entire outfit, and as opposed to simply purchasing a lesser expensive and suitably decorated outer skin for use with a previously purchased base outfit.

As will be further described, the system can encompass any hunting or military related applications in which it is desired to exhibit a maximum number of different camouflage patterns with a minimum of outerwear gear. Additional non-related recreational pursuits which can take advantage of the present system include, without limitation, such as paintball or snowboarding, as well as any other recreational pursuit where there is an advantage in the ability to provide fast changing outer skins.

The skins additionally can integrate any number of integrated components, such as without limitation including ballistic resistant (Kevlar®) panels, accessory support portions, and hydration packs. Other features of the skins can include infrared (IR) or thermal insulating properties, additional variants further contemplating more one skin being applied in successive layered fashion depending upon the operational environment.

Figure 1:
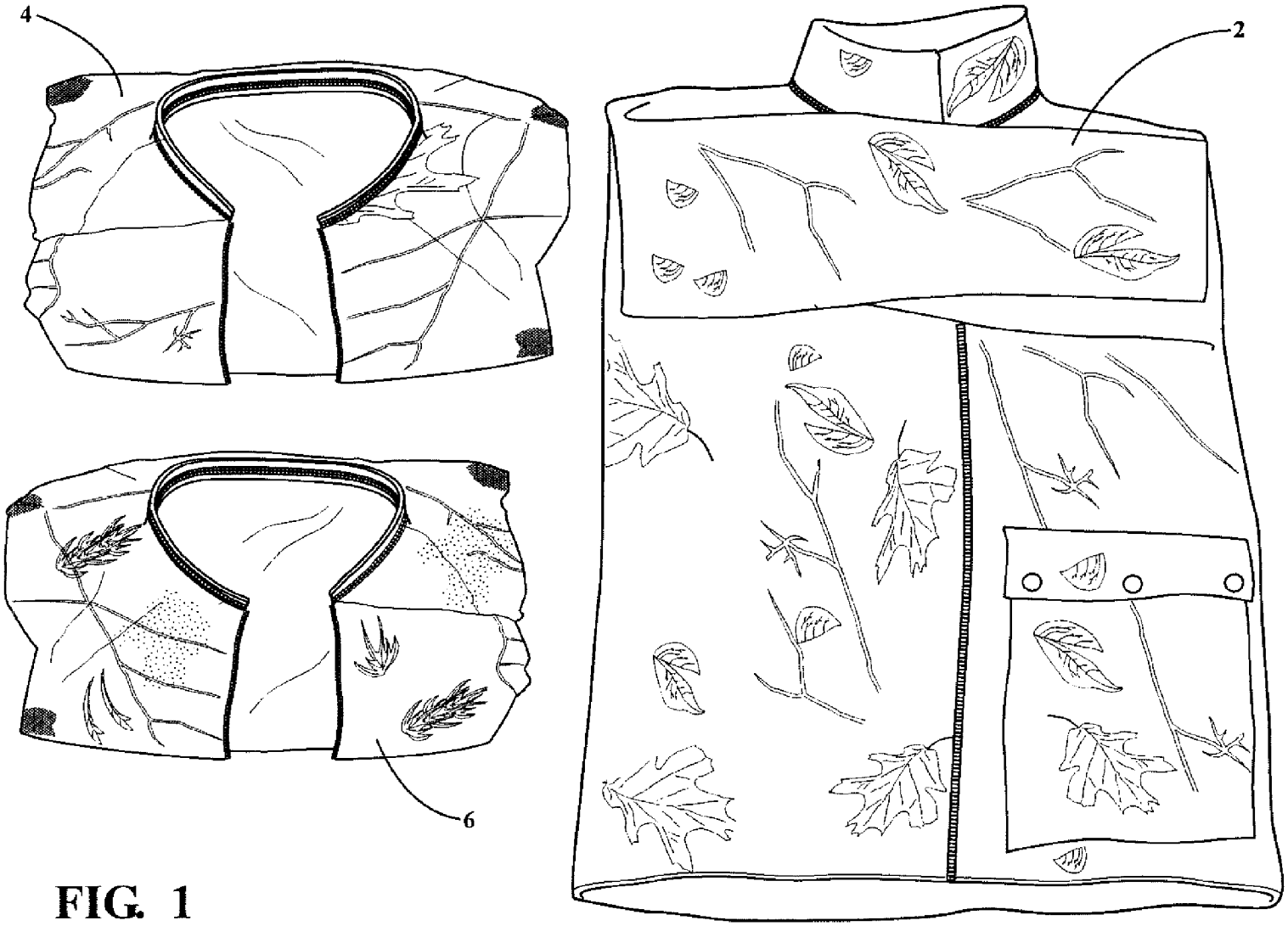
FIG. 1 is an operational illustration of an the outerwear assembly composed of a base wearable garment along with first and second separately attachable skins, each exhibiting a different camouflage pattern.

Given the above explanation, FIG. 1 is an operational illustration of an the outerwear assembly composed of a base wearable garment 2 along with first 4 and second 6 separately attachable skins, each exhibiting a different camouflage pattern. The garment 2 and skins 4 and 6 are depicted in a folded configuration in this illustration however are understood to include any of a one piece jumpsuit style outerwear garment or a two piece garment including bibs or pants in combination with any style of jacket or top. As will be further explained, base garment and outer attachable skins can be constructed of any natural or synthetic material, such as including, such as which can include any necessary pre-treatment for increased durability, water resistance and, where applicable, scenting applications which may be suitable for a given environment or application.

Without limitation, it is further understood that additional properties integrated into the skins 4 and 6 can include a liner or coating layer of an infrared (IR) or thermal resistant material, such as which can be donned by personnel in the field in short order, and such as to retard the effects of enemy combatant's IR or thermal imaging capabilities. Although not shown, the skins can further include a hooded portion or the like, such as which can be integrated into a zippered neck extending compartment.

Figure 2:
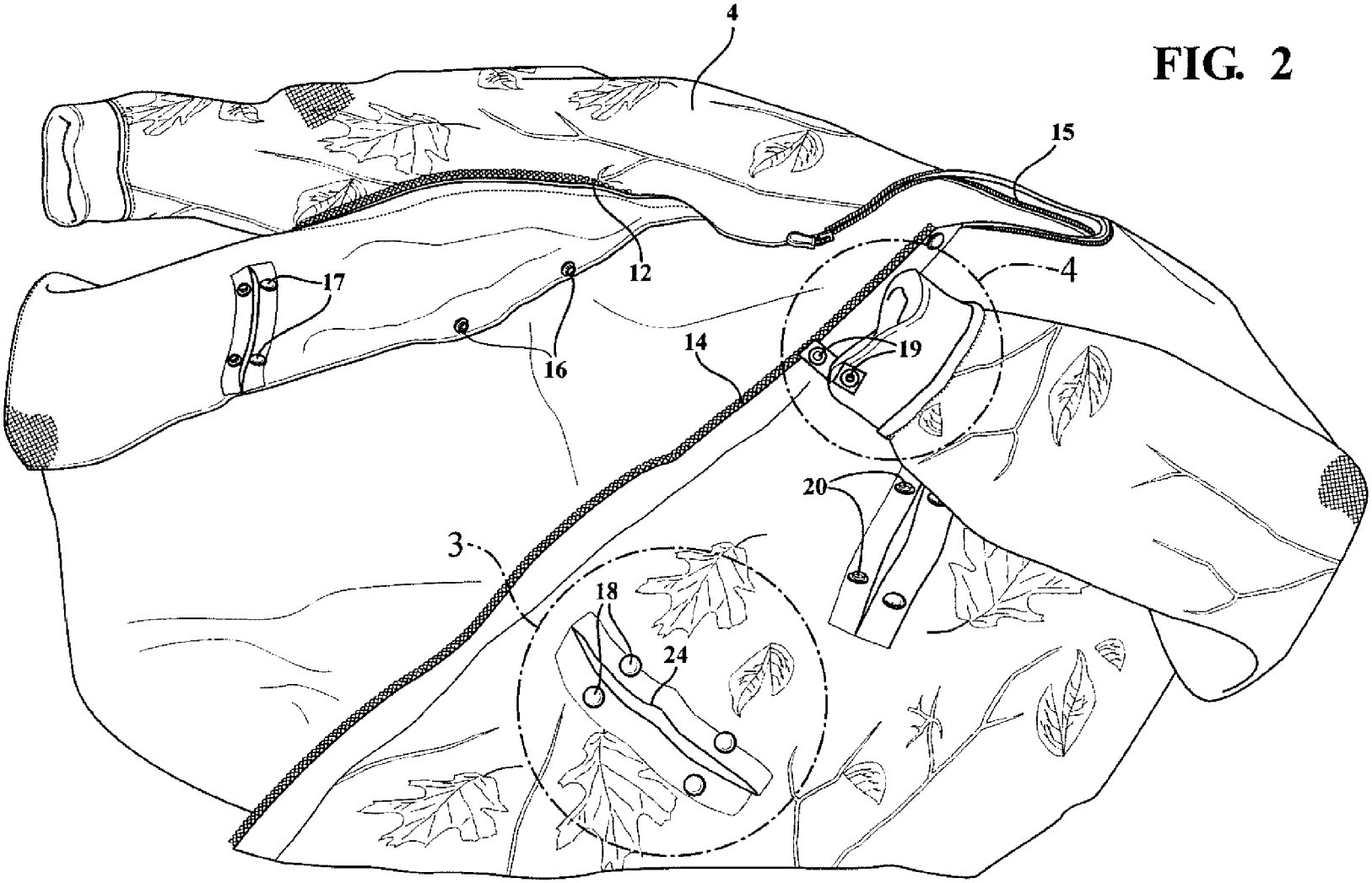
FIG. 2 is a succeeding unfolded and partially open view of an outer jacket skin forming a portion of the present system.

Referring to FIG. 2, a succeeding unfolded and partially open view of an outer jacket skin, again shown in FIG. 1, is depicted forming a portion of the present system and which can include any arrangement of fasteners not limited to zippers 12 & 14 and 15 and snaps 16, 17, 18, 19, 20, et seq. As will be described in further detail, the attachment schemes can also include any of buttons, mutually adhering magnetic portions, and hook and loop fasteners which are integrated into opposing aligning locations of the base wearable garment and selected outer skin and which facilitate fast attachment or substitution of a given skin, such as in response to an environmental or tactical scenario with which the wearer is confronted. As further shown, a selected cargo pocket pass through (slit) location is further depicted at 22 in proximity to snaps 17, the configuration of which facilitates installation of the outer skin 4 or 6 in an aligning and inter-engaging location associated with the wearable base garment.

Figure 3:
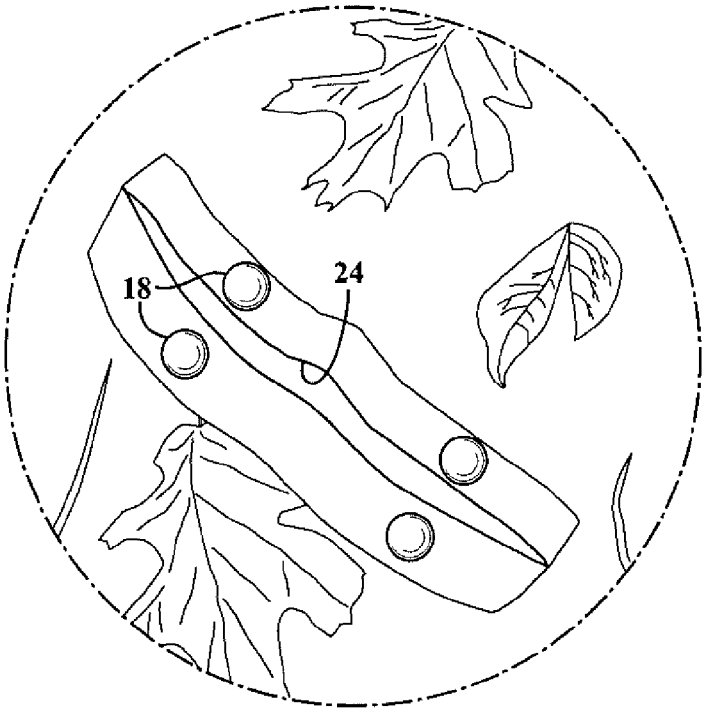
FIG. 3 is an enlarged view of section 3-3 in FIG. 2 and showing a cargo pocket pass through from an outer side corresponding to an inner lining side as illustrated in FIG. 2.
Figure 4:
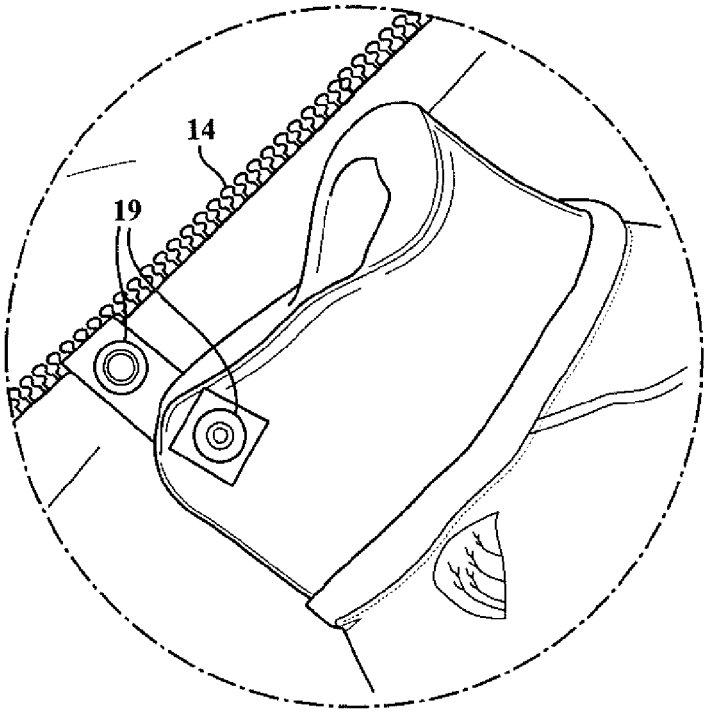
FIG. 4 is an enlarged view of section 4-4 of FIG. 2 and showing a sleeve cuff attachment protocol for securing a selected outer skin to the jacket shell.

Also illustrated is a chest pocket pass through location of the jacket skin along with a selected sleeve, as well as another view of a cargo pocket pass through, at 24, from an outer side corresponding to the inner lining side. FIG. 3 is an enlarged sectional view taken from FIG. 2 and depicting a cargo pocket pass through from an outer side corresponding to an inner lining side as illustrated in FIG. 2, the snaps shown at 18 being integrated into reinforced lining portions defining the pass through slit or location 24. FIG. 4 provides another enlarged sectional view of a sleeve cuff attachment protocol for securing a selected outer skin to an associated and base wearable garment or jacket (not shown in this view).

Figure 5:
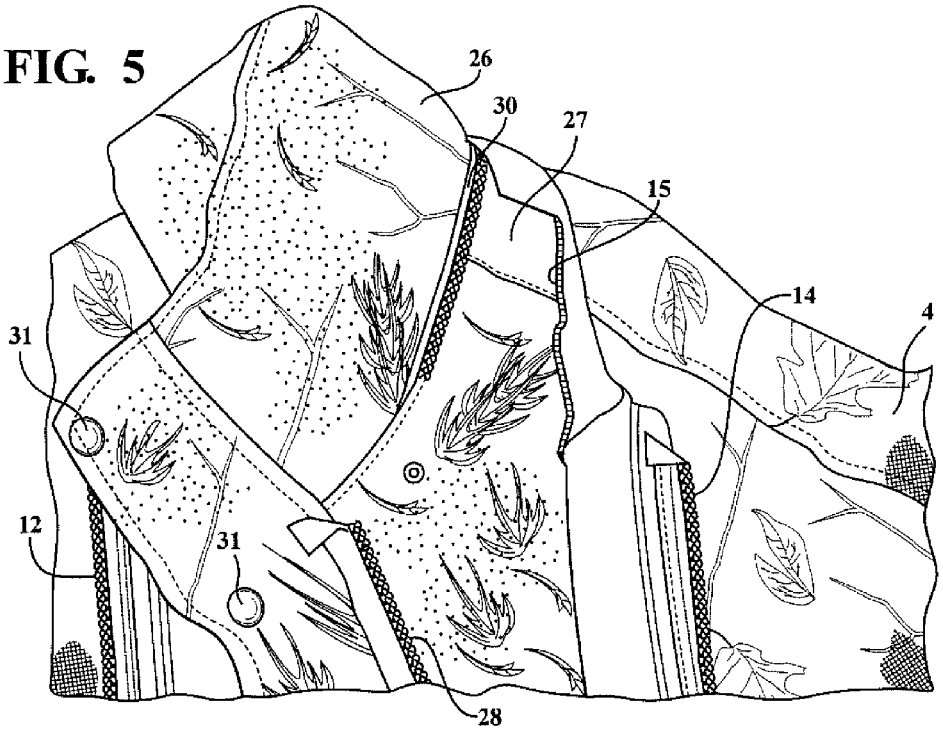
FIG. 5 is an initial assembly operation step in which the outer jacket skin is pre-positioned upon an associated base suit and further depicting aligning zipper locations associated with the chest and neck of the jacket skin which align with similar zipper locations of the base suit.

Proceeding to FIG. 5, an initial assembly operation step is depicted in which the outer jacket skin 4 is pre-positioned upon an associated base (garment), this depicted at 27 and which again can include any of a one-piece jump suit or can be provided as separate pants (or bibs) along with a jacket or coat. Further depicted at selected and aligning locations are additional zippers (one side extending zipper visible at 28 along with an exterior neck extending zipper and 30), these associated with and opposing the zippers 12, 14 and 15 associated with the chest and neck of the selected skin, again at either 4 or 6. Other snaps are shown at 31 along a collar portion of the base garment 27 and which can also be configured to engage opposing snaps associated with the base garment or a suitably configured and inwardly folding edge location (not depicted in this variant) of the attachable skin 4.

Figure 6:
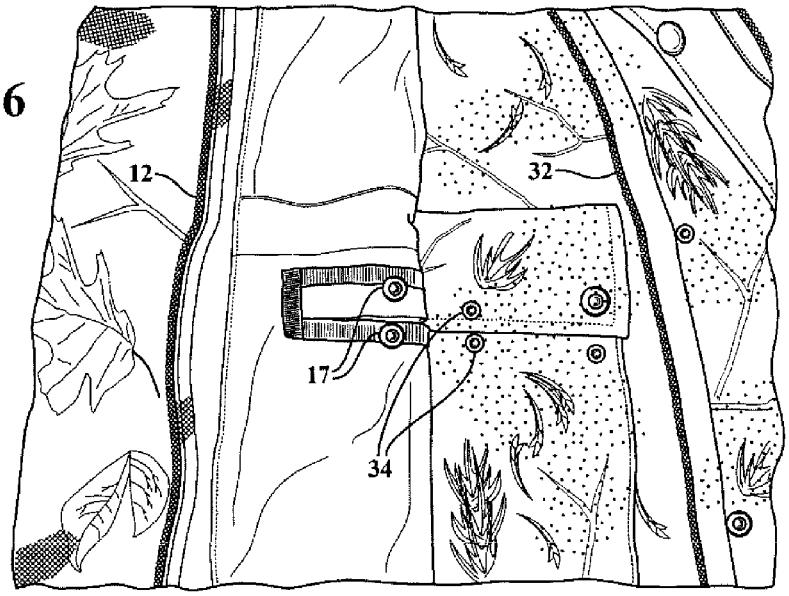
FIG. 6 is another illustration of the outer skin laid upon a base suit and further depicting each of aligning chest zippers and snap attachments configured at cargo pocket locations associated with each article.
Figure 7:
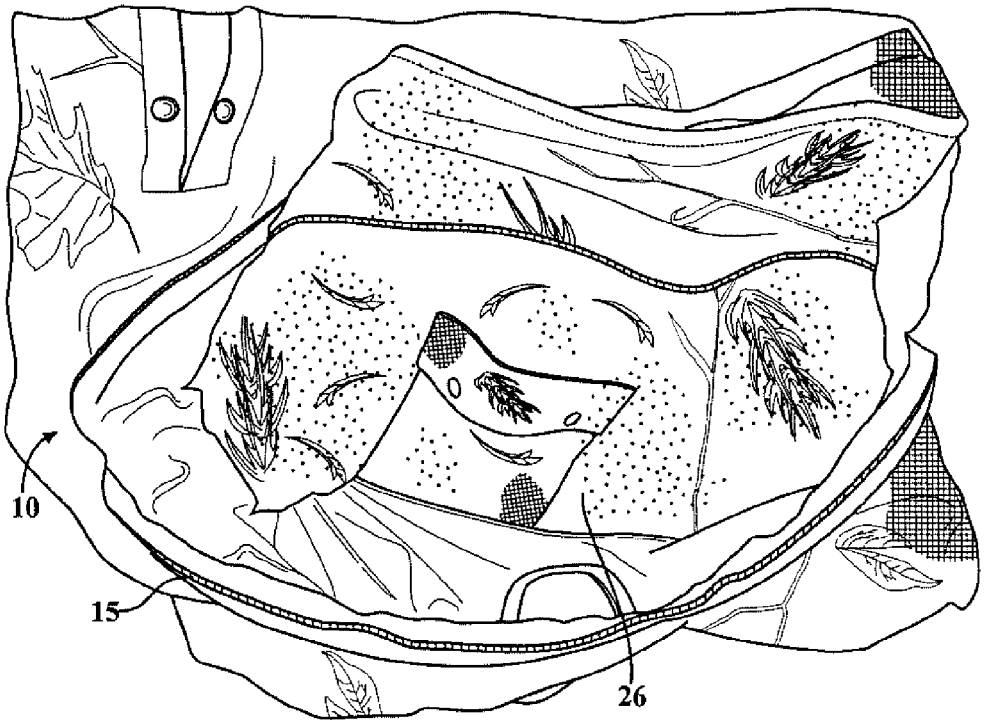
FIG. 7 illustrates, in wide view, the zipper attachment of the outer skin to the base suit at the overlapping neck area.

FIG. 6 is another illustration of an outer skin laid upon the base garment or suit and further depicting each of aligning chest zippers 12 (again for skin) versus at 32 (for base suit) and in addition to snap attachments configured at cargo pocket locations associated with each article (i.e. at 17 as previously identified for skin 4 or 6 in FIG. 2 as well as further at 34 for base suit). FIG. 7 presents a close in illustration of an outer skin again exhibiting a zipper attachment 15 extending around a neck area of a base suit exhibited by a similar zipper attachment 30.

Figure 8:
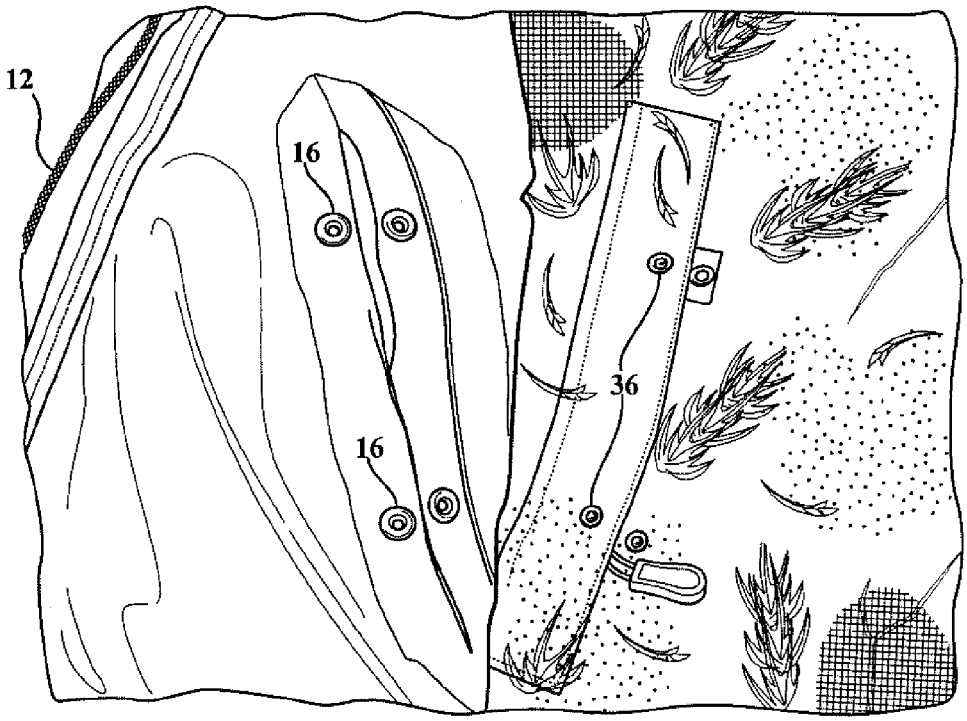
FIG. 8 is an illustration of the outer skin depicting snap attachments at the chest pocket location.
Figure 9:
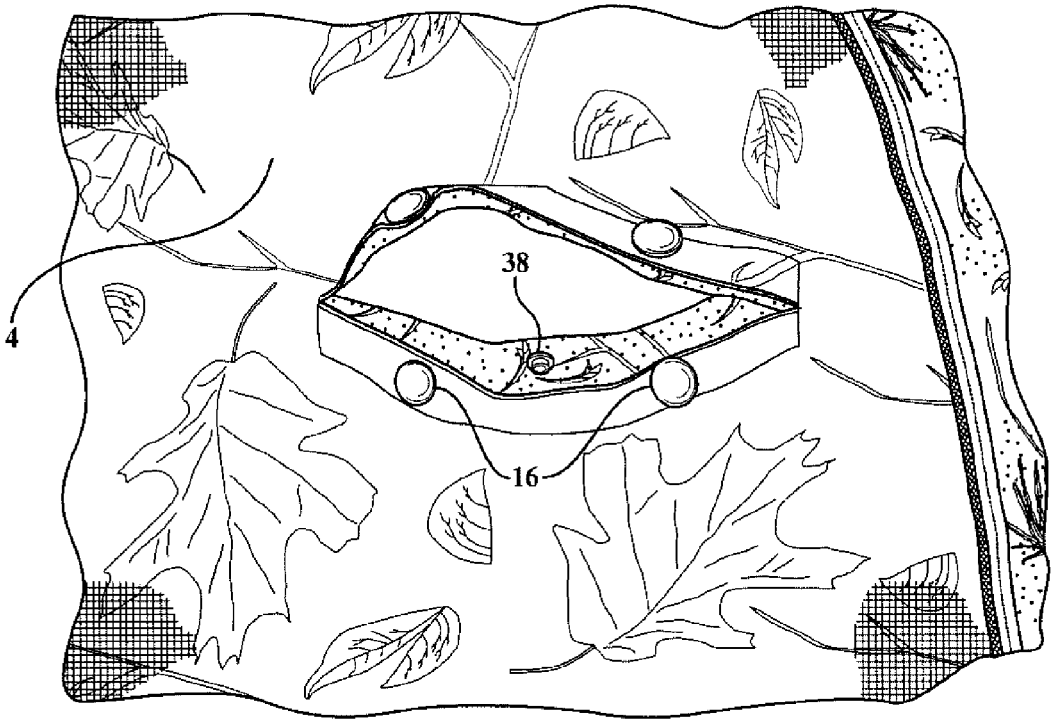
FIG. 9 is a depiction of the outer skin or layer applied over the base suit at the cargo pocket area in an open condition.
Figure 10:
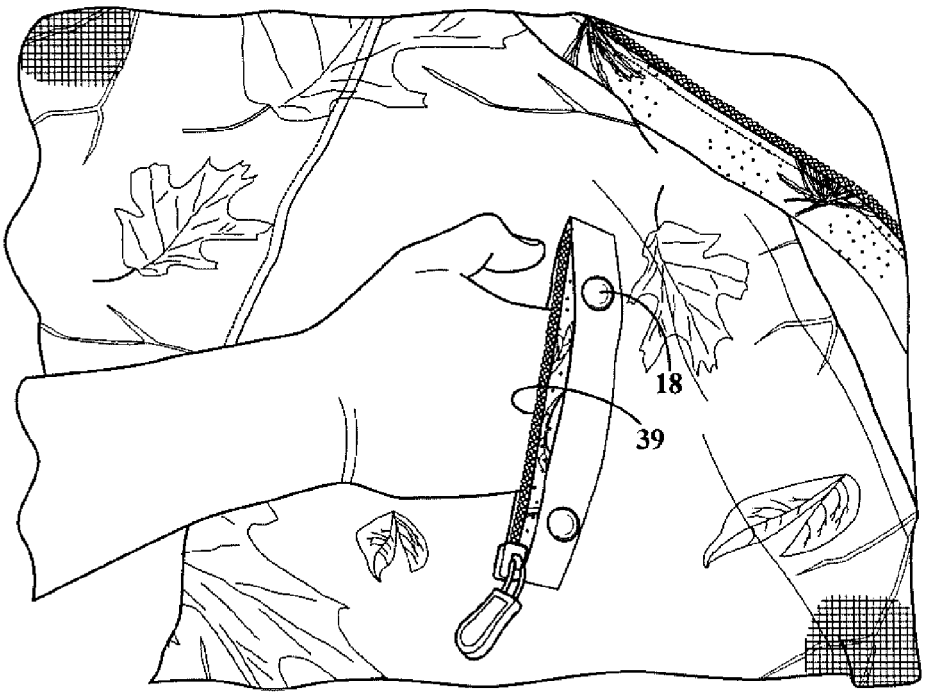
FIG. 10 illustrates the skin over the base suit with the cargo pocket closed.

Proceeding to FIG. 8, an illustration is provided of the outer skin depicting snap attachments, see as also previously depicted at 16 in FIG. 2, at the chest pocket locations and which align with additional snap attachments 36 associated with an exterior mounting location of the base garment. FIGS. 9-10 depict variants of the outer skin or layer applied over the base suit at the cargo pocket area of FIG. 8 in an open condition, with the cargo pocket subsequently being closed through the inter-engagement of any desired combination of snap attachments. In this instance of FIG. 9, snaps 16 associated with the selected outer camouflage skin design can be engaged with any suitable arranged plurality of snaps, such as depicted at 38, associated with the base garment.

In the further instance of FIG. 10, a similar illustration is provided of the outer skin over the base garment taken at the chest pocket location, with the provision of both outer snap locations 18 associated with the slit defined in the skin, this engaging to interior aligning snaps of the base garment (not shown in this illustration) such that the associated slit defined in the outer skin provides the wearer with both ease of installation of the outer skin to the underlying garment 26 as well as ease of access to the interior pocket defined in the base garment. FIG. 10 further depicts the outer skin arranged over the base suit and illustrating the pass through slit defined in the chest pocket location and which can further include a zippered portion 39, such as further capable of being defined in mating fashion between engaging edges of the base suit and attachable skin in a manner which can complement or substitute for the inter-engaging snaps as previously described.

Figure 11:
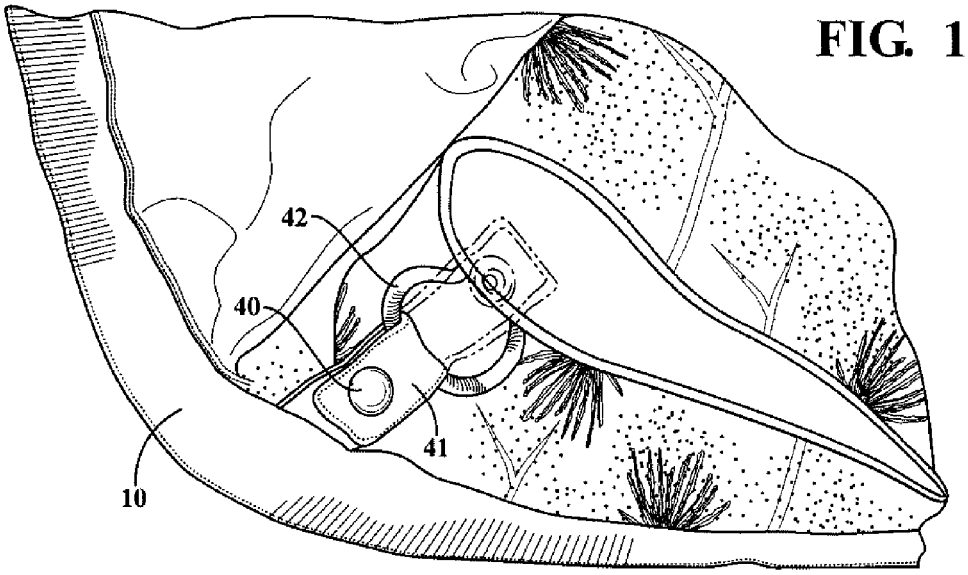
FIG. 11 is a close up illustration of loop and snap attachment portions configured between the outer skin and the bottom of the base suit and in both open and engaged positions.
Figure 12:
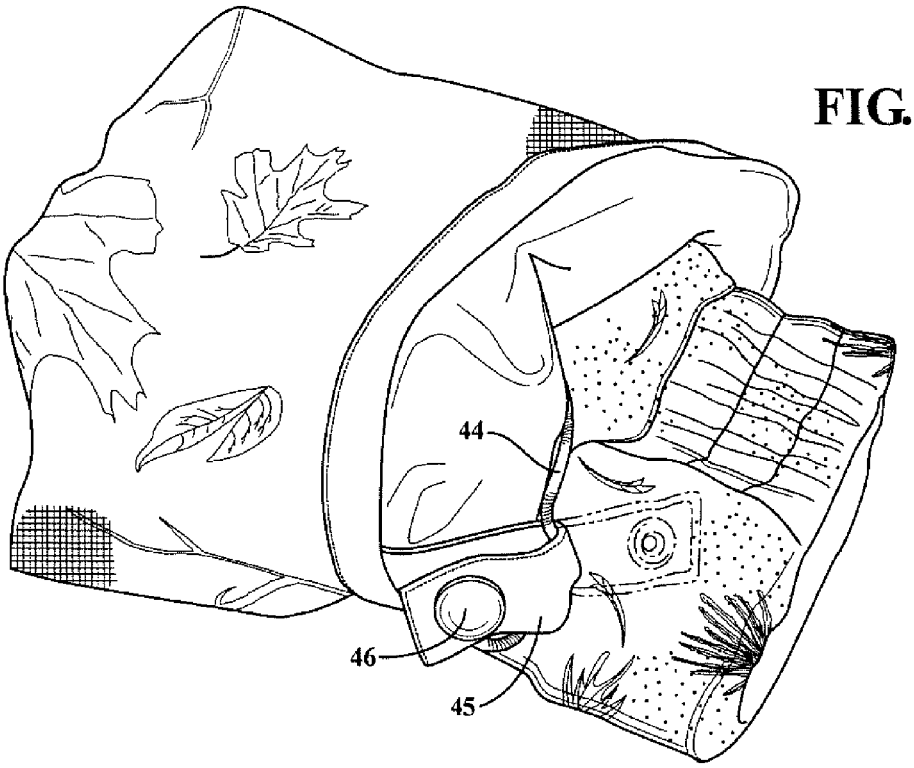
FIG. 12 illustrates the outer skin at the cuff location and showing a similar arrangement of loop and snap attachments in both open and engaged positions.
Figure 13:
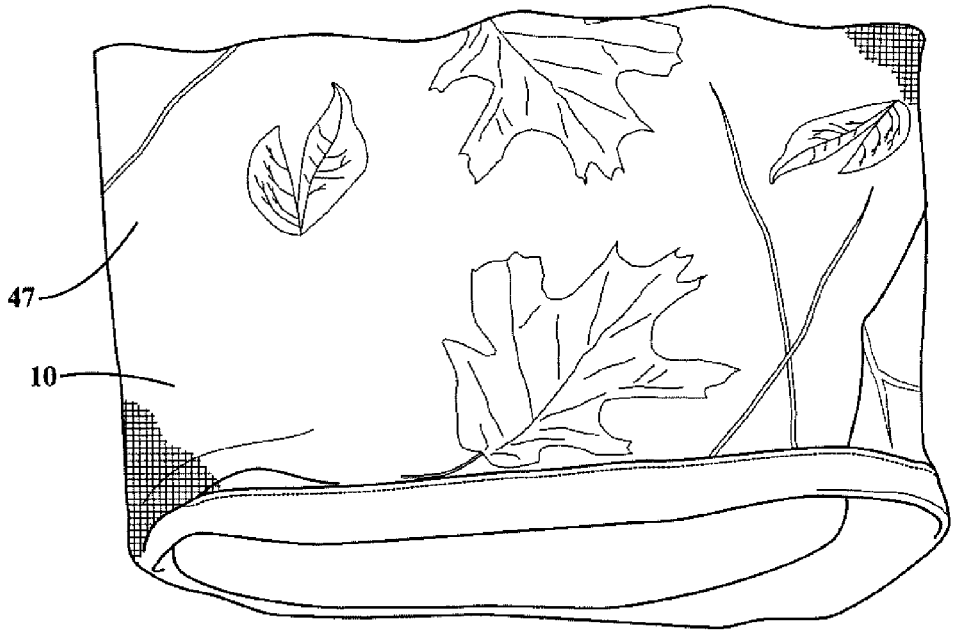
FIG. 13 is a depiction of an outer skin at the cuff location showing a fully engaged position relative to the base suit.

FIG. 11 provides a close up illustration of a selected pair of inter-engaging snap attachment portions, see at 40 configured at spaced locations along a strap portion 41 extending from a skin (such as again either at 4 or 6 in FIG. 1), the strap extending through a loop 42 defined at the bottom or leg cuff of the base garment suit or pants. As depicted, the supporting length of fabric defining the strap portion 41 is weaved through the loop 42, with the spaced apart and opposing pair of snaps (one of which is shown at 40) shown in inter-engaged fashion to provide for engagement of the outer (pant shaped) skin at that location. Similarly, FIG. 12 illustrates the outer shell at a cuff location and showing a similar fastening arrangement of a loop 44 (associated with the base garment) and tab or strap 45 supported snap attachments (one of which is shown at 46) extending from a mounting location of the outer skin and which are likewise inter-engaged after weaving through the loop 44. FIG. 13 is a further depiction, at 47, of the outer skin at the cuff location of FIGS. 11-12, showing a fully engaged position relative to the base suit.

Figure 14:
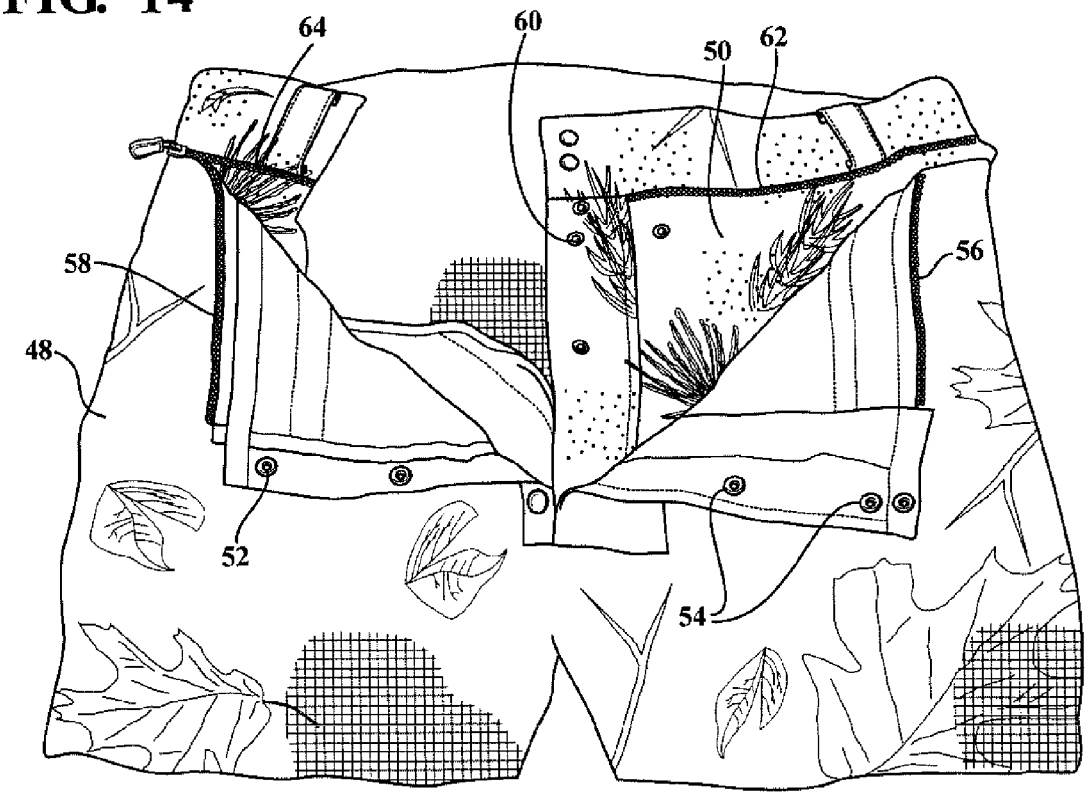
FIG. 14 is an illustration of the outer skin attached to the pants portion of the base suit.
Figure 15:
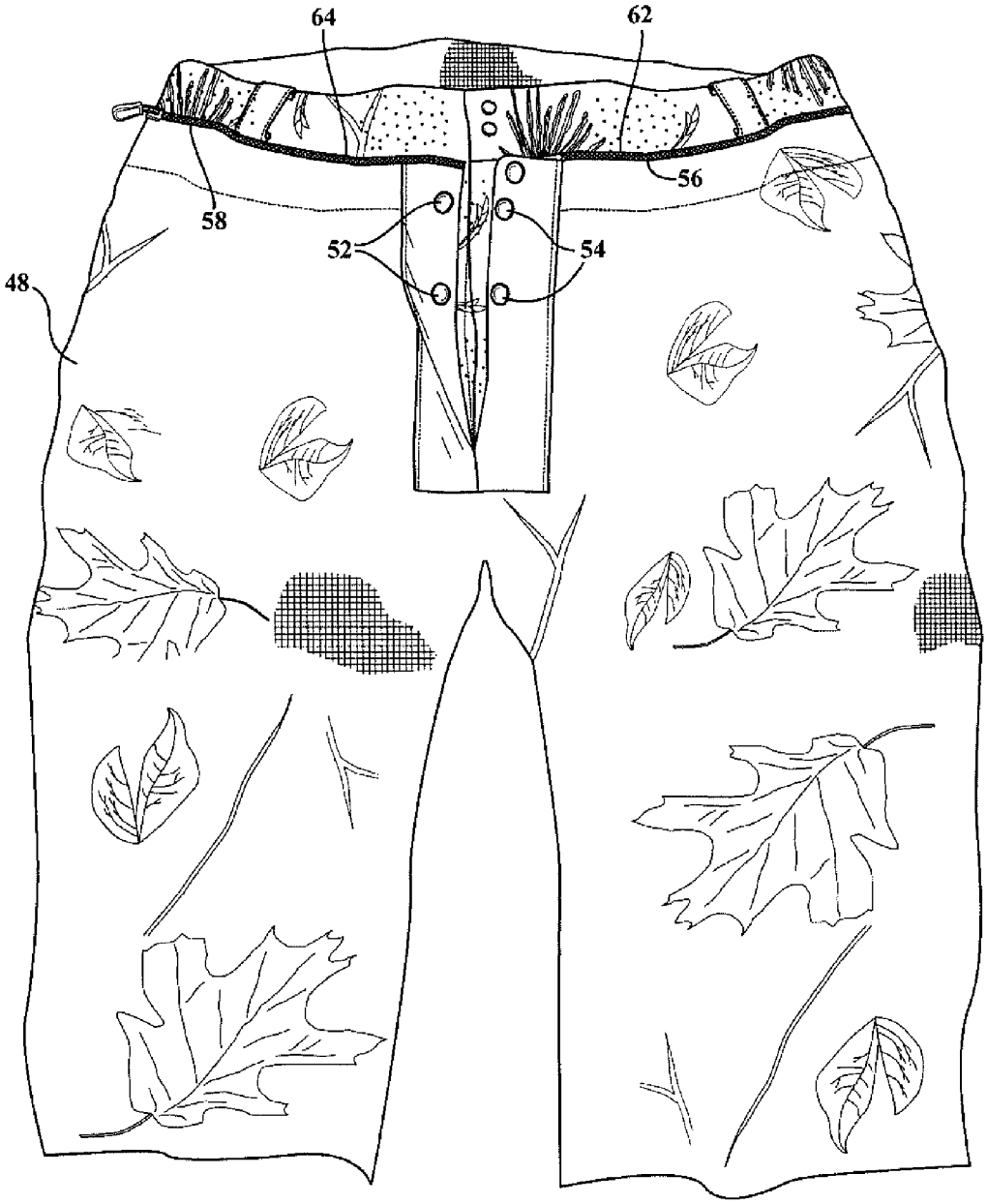
FIG. 15 illustrates the zipper and snap attachments established between the outer skin and the base suit at the waist area.

Proceeding to FIG. 14, an illustration of a further pants configured outer skin is generally depicted at 48, attached to a pants portion of the base suit, at 50. As further shown in FIG. 15, aligning zipper and snap attachments are established between the outer skin and the base garment (pants) at the waist area. Specifically, shown are snaps 52, 54, et seq. and zippers 56 and 58 associated with the pants skin 48, these aligning with inter-engaging snaps defined at locations upon the base garment 50 and as best depicted by selected snaps 60 (aligning with snaps 54 of the pants skin 48) and selected waist zippers 62 and 64 of the base garment 50 which align with the zipper locations 56 and 58 at locations along the skin 48. In this fashion, the outer skin is fully engaged at the waist and associated access areas by inter-engagement of the zippers and aligning snap profiles defined with the base suit, with FIG. 15 again best depicting the outer skin engagement snaps 52/54 and upper edge extending zippers 56/58 at the waist area for mounting to the associated zippered edges 62 and further at 64 associated with the base pants (also termed bibs) 50.

Figure 16:
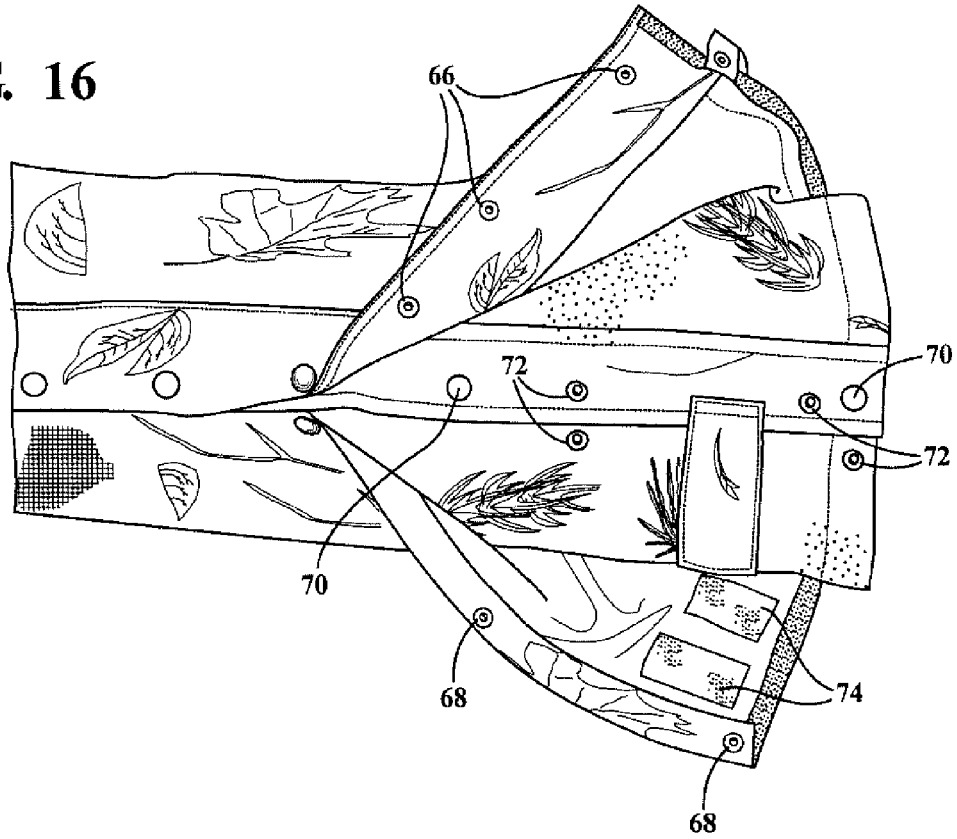
FIG. 16 is an illustration of the outer skin at a boot welt associated with the underlying base suit bottom (or pants) and depicting an engagement scheme of snaps and hook & loop attachments (e.g. Velcro®) portions established between the inner and outer layers.

Referring now to FIG. 16, an illustration is shown of the outer skin at a boot welt associated with the underlying base suit bottom (or pants) and depicting an engagement scheme of individually and opposing pluralities of extending snaps 66/68 (skin) and further at 70/72 (pants), this in addition to the provision of hook & loop attachments (e.g. Velcro®) portions established between the inner and outer layers and which is shown by non-limiting Velcro® portions at 74 along inner surfaces of the boot welt area of the outer skin which engage aligning locations on surfaces of the pants. Without limitation, the hook and loop fasteners, such as at 74, can be configured to engage locations on the skin, the base garment, or other inter-engaging locations between the skin and base garment.

Further shown are the manner in which the aligning and overlapping snaps established between the outer skin and the boot welt of the base suit mate in order to provide a secure closure between the elements. FIG. 19 further provides a further semi-engaged position of the scheme of FIG. 16, the outer skin engaging to the boot welt area and leg cuff.

Figure 17:
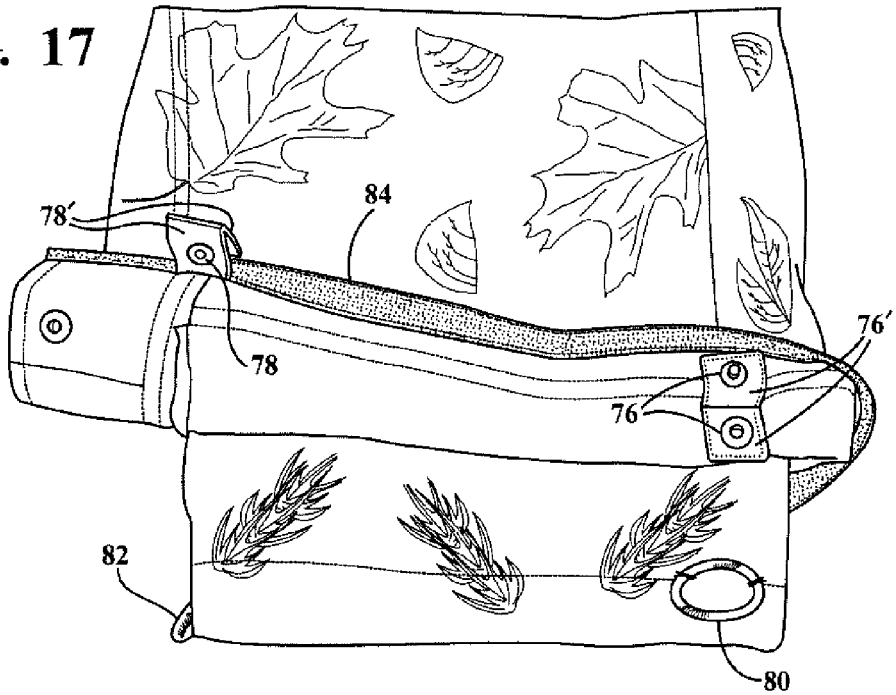
FIG. 17 is a succeeding view FIG. 30 showing the edge of the skin peeled back to depict the unique snap and hook & loop scheme.

FIG. 17 is a succeeding view showing the edge of an outer skin peeled back to depict a further configuration of snaps, at 76 and 78 which extend from tabbed fabric locations 76' and 78', these engaging through loops 80 and 82 further defined upon the leg cuff of the pants of the base suit. According to any of a number of non-limiting varieties, suitable inter-engaging schemes between the base suit and selected outer skin can envision alternately configured schemes of hooks, snaps, zippers, Velcro® or other suitable inter-engaging fastener portions employed in any alternate or complementary fashion in order to facilitate fast attachment of the various locations established between the outer skin and inner suit. As further shown in FIG. 18, a rotated and enlarged view of the scheme of FIG. 17 additionally shows a bottom extending zipper 84 associated with the skin leg cuff, this capable of inter-engaging with another zipper (hidden from view) and which can be defined upon an inside trim edge of the underlying leg cuff of the base pants.

Figure 20:
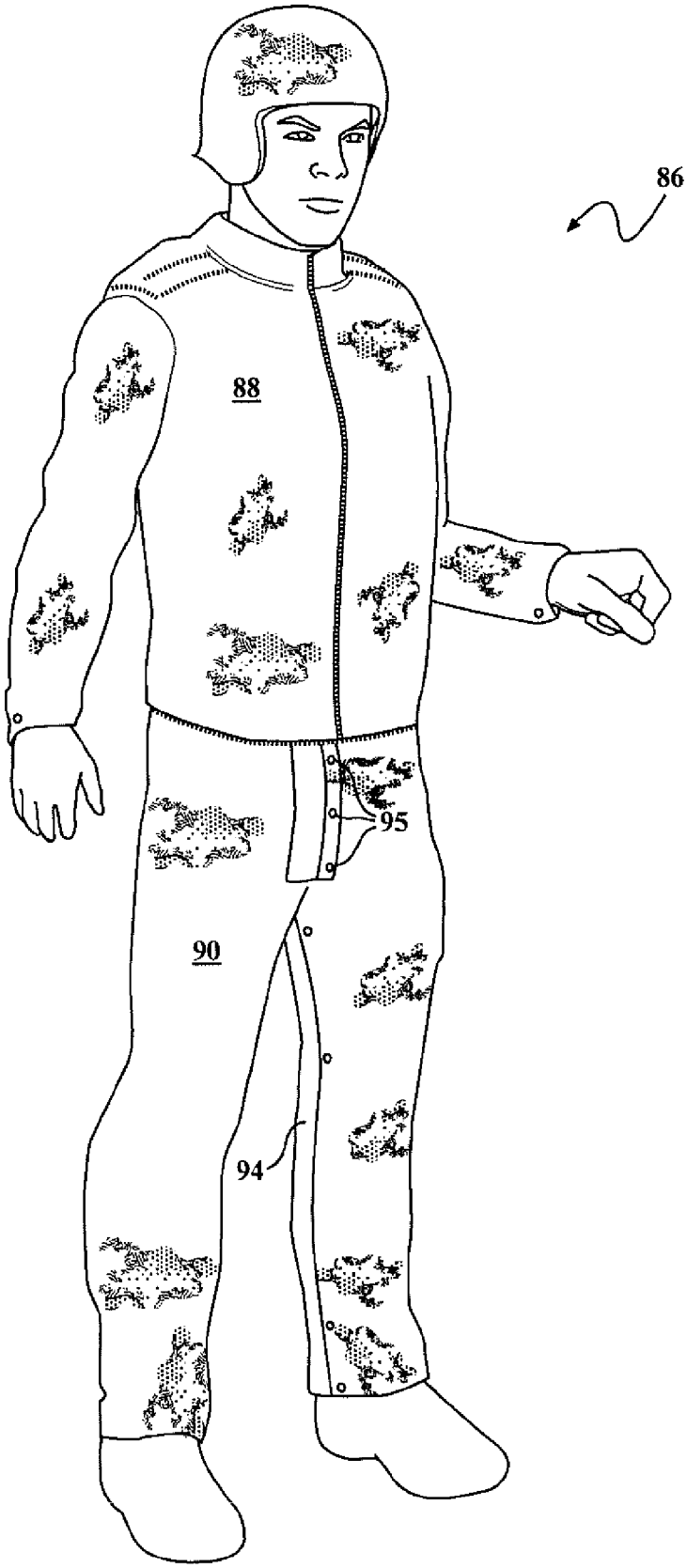
FIG. 20 is an operational view of an outerwear system according to a further embodiment and which incorporates jacket and pants with individually attachable skins exhibiting a desired camouflage pattern.

Proceeding to FIG. 20, an operational view is generally shown at 86 of an outerwear system according to a further and non-limiting embodiment and which incorporates jacket and pants (hidden) with individually attachable skins, including a top jacket skin 88 and a bottom pant skin 90, each illustrated as exhibiting a desired camouflage pattern, such as a digital style pattern which is commonly used and assists in providing necessary background camouflage depending upon the environment the wearer is operating in. Without limitation, any of the attachment schemes previously described can be incorporated into the embodiment of FIG. 20 and such as further in which the pants skin 90 can exhibit inner split edges (see at 94), along with front snaps 95, and which enable the skin 90 to be quickly attached to the base pants without the user having to remove his or her boots. The upper or top skin 88 can also be attached to the under worn garment in a similar fashion as described in reference to FIG. 2 et seq. and can take advantage of any combination of snaps, zippers, buttons, magnetic attracting portions, hook and loop fasteners or the like.

Figure 20A:
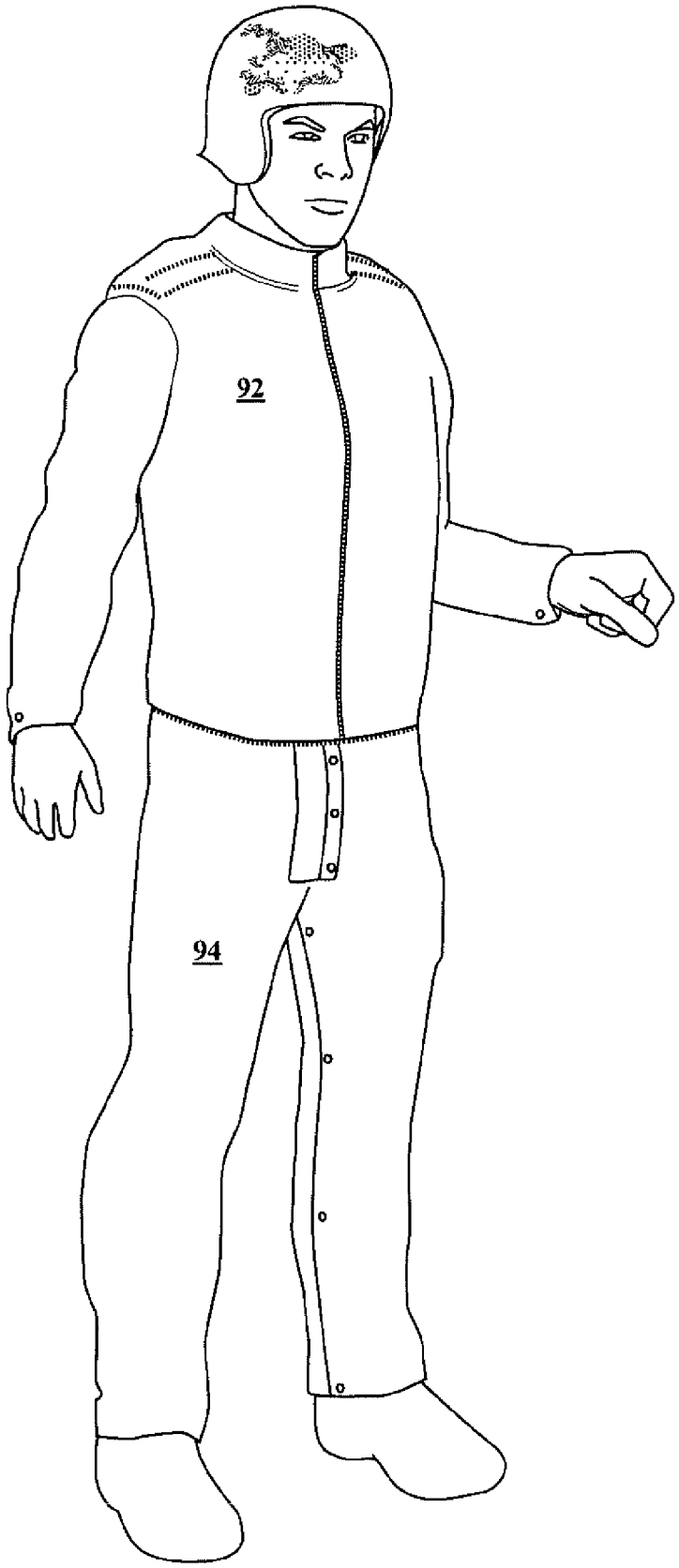
FIG. 20A is an illustration similar to FIG. 20 and illustrating outer attachable skins which may include no surface patterning and which may further include any layering or composition of an IR or thermal shielding or insulating material.

Proceeding to FIG. 20A, an illustration similar to FIG. 20 is provided and illustrating outer attachable skins 92 and 94 which may include no surface patterning and/or may only include a given consistent coloring such as which may also be suited for operation in a given environment. Consistent with the previous description, the construction of the outer attachable skin may further include any layering or composition of an IR or thermal shielding or insulating material, such as which may counter the effects of an enemy combatant's imaging technology in this respect.

Figure 21A:
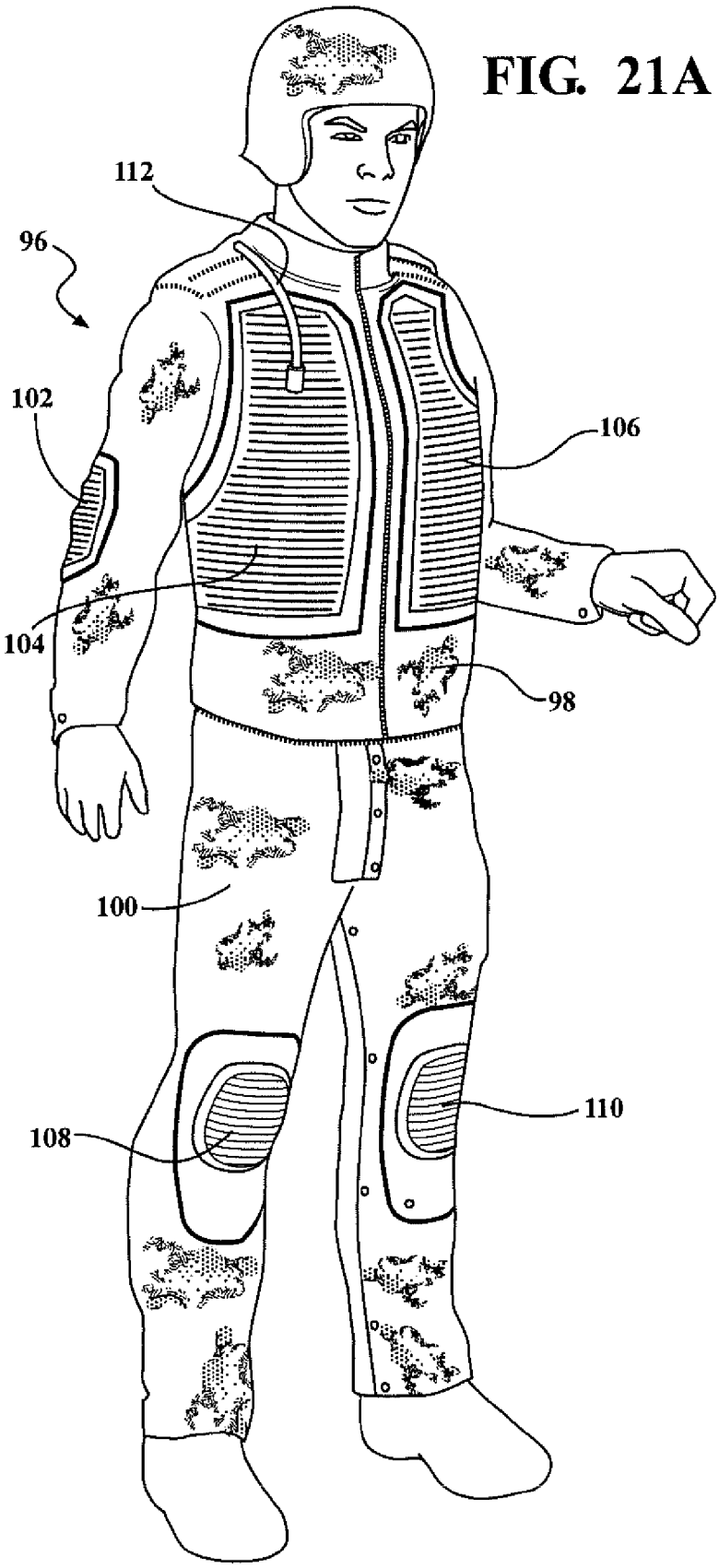

FIG. 21A is an illustration, generally at 96, is shown of a further variant of a customizable outerwear system in which upper 98 (top) and lower 100 (pant) attachable skins are depicted attached over a one or (typically) two piece base garment. The skins 98 and 100 are typically provided with a dual outer/inner layers (the outer layer of which is removed in this variant but would normally cover ballistic impact resistant portions (see at 102, 104 and 106 integrated into upper skin 98 and further at 108 and 110 integrated into lower skin 100), such that the attachable skins 98 and 100 can be quickly retrieved by the user and attached over the base garments (such as further after removing a previously worn thin skin not including such ballistic protection features).

Figure 21B:
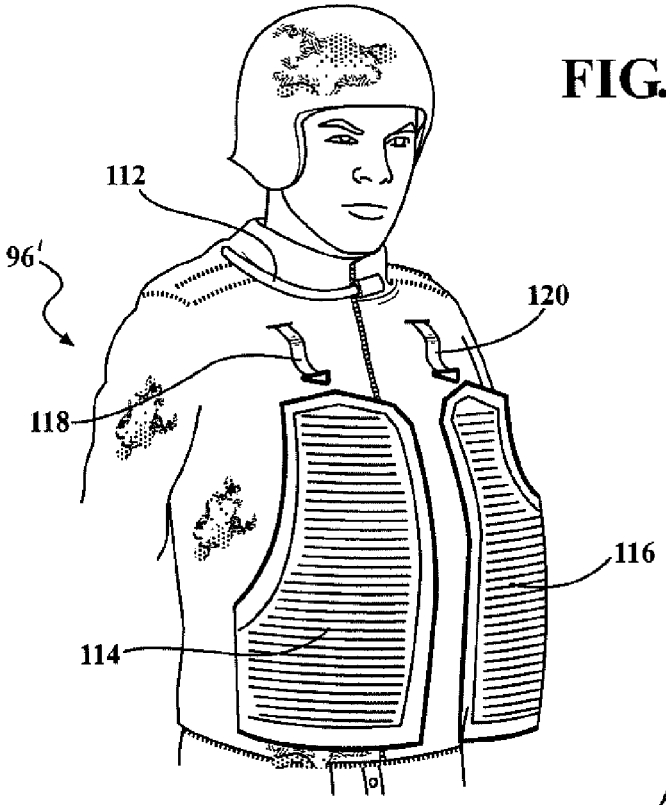
FIG. 21B is an alternate illustration to FIG. 21A and depicting a redesign of the ballistic resistant panels along with such additional features as extending accessory engaging straps and neck positioned hydration tube.
Figure 22B:
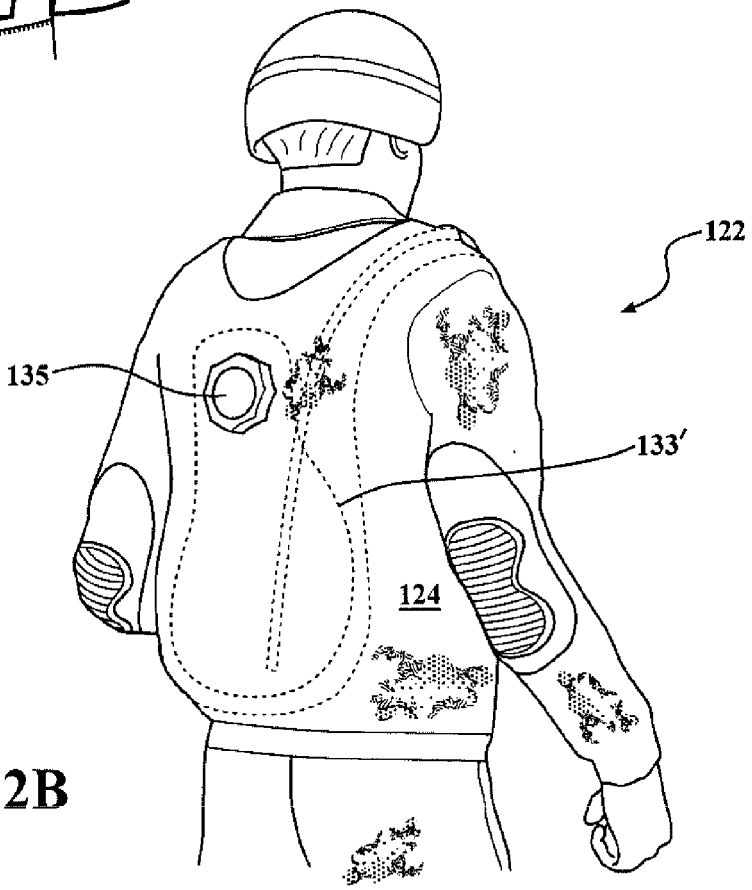
FIG. 22B is an alternate illustration to FIG. 22A and depicting the hydration pack in phantom lines to represent it being sewn or otherwise hidden between inner and outer skin layers.

Without limitation, such outerwear systems envision outer attachable skins which may integrate any combination of features not limited to the ballistic impact resistant panels (such as provided as Kevlar® portions sewn or otherwise formed into the skin), as well as such other features as integrated hydration packs (see further in FIG. 22 and as further depicted by collar located drinking straw 112. It is also envisioned that the armored attachments/panels and/or the other accessories can also be configured on the exterior of the skin (without provision of an outer layer), and in such instances a suitable coloring or camouflage pattern may also be applied over the ballistic impact resistant panels or other accessories. FIG. 21B is a variant 96' of FIG. 21A and depicts a redesign of the ballistic resistant panels, at 114 and 116, and further shows such additional features as extending accessory engaging straps 118 and 120 (these often including clip or snap ends) and which are secured to the skin for engaging such as a binocular, flashlight or other accessory, the upper skin separately depicting the neck positioned hydration tube 112 of FIG. 21A.

Figure 22A:
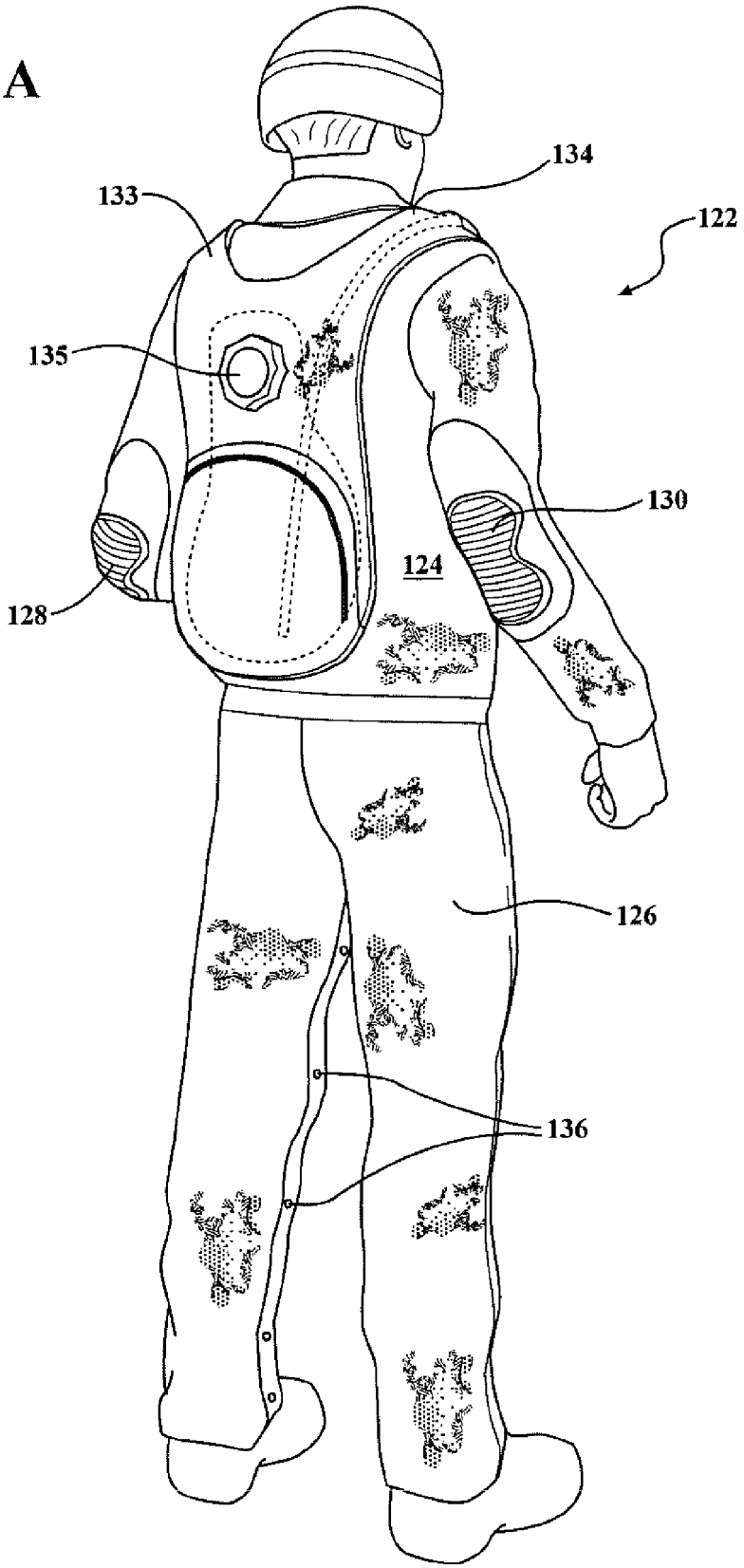
FIG. 22A is a rear perspective operational view of an outerwear system in which the ballistic impact resistant panels and hydration pack are exhibited on an exterior surface of the attached skin.

FIG. 22A is a rear perspective operational view of an outerwear system, generally at 122, in which are shown redesigned upper 124 and lower 126 skins, the upper skin 124 integrating redesigned ballistic impact resistant panels (illustrated at 128 and 130 which are associated with elbow locations of selected upper skin 124). Also better depicted is a hydration pack incorporating a fluid reservoir or pouch 132 integrated into structurally supporting vest-like structure 133 which can be formed onto an exterior surface of the skin 124 or, again without limitation, can be integrated between inner and outer layers defining the skin such that the hydration pack is hidden within the skin and as further depicted in FIG. 22B in phantom 133'. An extraction tube is further shown at 134 (see FIG. 22A) and extends from the fluid (e.g. water or other water based replenishing fluid) reservoir to the front collar located drinking straw 112, with a reservoir refill port further depicted at 135. Snaps 136 are shown in FIG. 22A and which, as previously described, can define inner split (or chaps) locations of the exteriorly attachable pants skin 126 in order to provide quick attachment.

As described previously, variants of the outerwear system contemplate a variety of skins, each individually attachable to the base garment and which can provide different features or functionality dependent upon the circumstances encountered by the wearer. In one non-limited scenario, a quick change outerwear system utilized by combatants can include a variety of skins, ranging from thinner skin camouflage articles (such as for use during reconnaissance and other non-combat tasks) to thicker (battle armored) skins which can quickly substitute for the thinner skins and can be provided with additional features and functionality which are often required in a combat scenario.

Without limitation, a variety of exterior skins provide scalability of use at lesser expense and inconvenience (such as permitting the skins not in use to either be carried by the user or stored in a readily accessible fashion within an accompanying military transport or the like). In this fashion, and upon impending or immediate battle conditions being encountered, the combatants (e.g. infantrymen or the like) can quickly exchange or attach a given (typically armored) skin, without having to first remove their underlying base suit or uniform (saving valuable time and convenience in instances of extreme environmental conditions).

As also previously described, other non-limiting applications of the present invention contemplates a plurality of alternately designed and generally identically configured camouflage style skins which can be substituted for each other in engagement over the base garment, this in order to change an outer camouflage appearance and without the wearer having to incur either the expense of alternately having to purchase a base outerwear exhibiting a given camouflage pattern, or having to obtain and carry multiple base outfits and as opposed to a single such base garment with multiple (thin) shells or outer skins. The versatility of the present system also contemplates a variety of uses not limited to military, recreational and/or hunting type applications. Without limitation, other such skin designs can include those tailored to identifying participants engaged in sporting or other team styled events.

Having described my invention, other and additional preferred embodiments will become apparent to those skilled in the art to which it pertains, and without deviating from the scope of the appended claims.

I claim:

1. A camouflage outerwear system comprising:

a wearable base garment including a jacket and a pants, each having at least one pocket;

a first plurality of fasteners incorporated into an exterior of said base garment and including each of:

a first plurality of zippers extending along a front and a neck of said jacket and a waist of said pants;

individual first sub-pluralities of snaps positioned around said pockets in each of said jacket and said pants; and at least one loop extending from each of a sleeve of said jacket and a leg cuff of said pants;

first and second pairs of outer skins, each pair including a jacket skin and a pants skin exhibiting a camouflage pattern, each of said jacket skin and said pants skin having at least one slit formed through an interior of said skin, said pairs of outer skins further including a second plurality of fasteners including each of:

a second plurality of zippers extending along a front and a neck of said jacket skin and a waist of said pants skin for inter-engaging with said first plurality of zippers;

second individual sub-pluralities of snaps positioned upon an inside surface of each of said jacket skin and said pants skin and around a circumference of said slits formed in said skins, said second snaps engaging said first snaps for aligning said slits over said pockets;

at least one strap extending from each of a sleeve of said jacket skin and a leg cuff of said pants skin, additional dedicated pairs of snaps being positioned at each of an intermediate location and an end location of each of said straps for securing each of said loops; and wherein said first and second pairs of outer skins are configured to be attached to and removable from said base garment while being worn by a user.

2. The system as described in claim 1, further comprising additional first pluralities of snaps positioned upon said base garment, additional second pluralities of snaps positioned upon said first and second pairs of outer skins.

3. The system as described in claim 1, said first and second pairs of outer skins each displaying a different camouflage decorative pattern.

4. The system as described in claim 1, said base garment further comprising a one piece suit.

5. The system as described in claim 1, further comprising one or more accessories integrated into at least one of said pairs of outer skins and being selected from the group including ballistic impact resistant panels, fluid reservoir holding packs, and accessory engaging straps.

6. The system as described in claim 5, said first and second pairs of outer skins further comprising inner and outer layers sandwiching said accessories therebetween.

7. The system as described in claim 1, further comprising at least one of said pairs of outer skins integrating at least one of an infrared resistant or thermal resistant coating or material.

* * * * *